US006968961B1

(12) United States Patent
Peete

(10) Patent No.: US 6,968,961 B1
(45) Date of Patent: Nov. 29, 2005

(54) ORGANIZER FOR TOOLS

(76) Inventor: Elizabeth Peete, 21 Orton Ave., Pontiac, MI (US) 48341

( * ) Notice: Subject to any disclaimer, the term of this patent is extended or adjusted under 35 U.S.C. 154(b) by 0 days.

(21) Appl. No.: 10/360,293

(22) Filed: Feb. 7, 2003

(51) Int. Cl.[7] ..... A47F 7/00
(52) U.S. Cl. ..... 211/70.6; 211/126.1; 211/71.01
(58) Field of Search ..... 211/70.6, 65, 71.01, 211/84, 13.1, 126.1; 108/27; 220/4.01, 500, 220/524, 553, 555, 752; 206/372, 373, 557, 206/561, 562, 563, 564, 822; D28/73, 77; 248/176.1, 176.2

(56) References Cited

U.S. PATENT DOCUMENTS

| | | | | | |
|---|---|---|---|---|---|
| 2,016,009 | A | * | 10/1935 | Johnson et al. | 312/300 |
| 2,018,651 | A | * | 10/1935 | Bates | 206/370 |
| D147,524 | S | * | 9/1947 | Barlow | D21/393 |
| 3,371,975 | A | * | 3/1968 | Meltzer | 55/385.1 |
| 3,456,806 | A | | 7/1969 | Borston | |
| D243,559 | S | | 3/1977 | Hoyle et al. | |
| 4,101,756 | A | | 7/1978 | Yamano | |
| 4,153,160 | A | * | 5/1979 | Leigh | 206/370 |
| 4,159,773 | A | | 7/1979 | Losenno | |
| 4,308,878 | A | | 1/1982 | Silva | |
| 4,354,093 | A | | 10/1982 | Zago | |
| 4,533,818 | A | | 8/1985 | Green | |
| 4,803,341 | A | | 2/1989 | Barowski et al. | |
| 4,871,074 | A | | 10/1989 | Bryson et al. | |
| 4,973,019 | A | | 11/1990 | Baird et al. | |
| 5,031,778 | A | | 7/1991 | Edgecombe | |
| 5,054,615 | A | | 10/1991 | Stillwagon et al. | |
| 5,090,649 | A | | 2/1992 | Tipp | |
| 5,124,532 | A | | 6/1992 | Hafey et al. | |
| 5,141,189 | A | | 8/1992 | Andrew | |
| D329,304 | S | | 9/1992 | Tipp | |
| D332,670 | S | | 1/1993 | McFarland | |
| D342,585 | S | | 12/1993 | Fischbach et al. | |
| 5,441,152 | A | * | 8/1995 | Estes | 206/570 |
| D371,220 | S | | 6/1996 | Behrens | |
| D377,996 | S | | 2/1997 | Gilbert | |
| 5,615,782 | A | | 4/1997 | Choe | |
| D379,554 | S | | 5/1997 | Landers | |
| D386,818 | S | | 11/1997 | Boomfield | |
| 5,727,701 | A | * | 3/1998 | Rhoades | 211/70.6 |
| 5,794,799 | A | | 8/1998 | Collins et al. | |
| 5,813,531 | A | * | 9/1998 | Kao | 206/373 |
| 5,826,719 | A | * | 10/1998 | Chen | 206/373 |
| D403,810 | S | | 1/1999 | Owens | |
| 5,988,382 | A | * | 11/1999 | Ritchie et al. | 206/372 |
| D423,717 | S | | 4/2000 | Taylor | |
| D426,025 | S | | 5/2000 | Holmes et al. | |
| 6,109,446 | A | | 8/2000 | Foote | |
| 6,123,299 | A | | 9/2000 | Zach, Sr. | |
| 6,193,414 | B1 | | 2/2001 | Balzano | |
| 6,230,888 | B1 | * | 5/2001 | Frieze et al. | 206/370 |
| 6,655,529 | B2 | * | 12/2003 | Ho | 206/373 |
| 2003/0010660 | A1 | * | 1/2003 | Lai | 206/373 |

* cited by examiner

*Primary Examiner*—Jennifer E. Novosad
(74) *Attorney, Agent, or Firm*—Honigman Miller Schwartz and Cohn LLP

(57) ABSTRACT

An organizer having a main body portion and a lip portion. The main body portion includes one or more wells, each well having a longitudinal length and a depth, well walls, and a front portion having an opening for receiving at least a portion of a tool. The lip portion is positioned adjacent the main body portion and includes one or more receiving members.

23 Claims, 7 Drawing Sheets

ORGANIZER FOR TOOLS

TECHNICAL FIELD

The present invention relates generally to an organizer that is suitable for organizing tools such as hair styling tools.

BACKGROUND

Hair stylists may use many styling tools during a styling procedure such as scissors, hairdryers, combs, brushes, electric clippers, interchangeable clipper blades, and curling irons. The styling instruments are constantly exchanged by the hair stylist and can tend to clutter the stylist's countertop or work-area. Commonly, curling irons are heated past room temperature to an effective temperature via a direct electrical connection or by a stove stand before being applied to a person's hair.

In some situations, a stylist may use and exchange a wide variety of heated irons having varying lengths and widths. For example, a first iron employed by the stylist may have to be temporarily set aside on a countertop or work-area so that a second, different iron can be employed by the stylist. The first iron, although not then in use, may still hold a significant amount of heat that could potentially burn and damage the countertop or even other tools, such as plastics combs or brushes on the countertop or work-area.

Even further, when more than two curling irons or interchangeable clipper blades (which can often have varying lengths and widths) are interchanged during a styling procedure, the countertop tends to get cluttered and thereby makes it difficult to keep track of and locate a specific iron or clipper blade when the stylist is concentrating on the styling procedure or attending to the customer. Yet even further, if irons are exposed to ambient air and not replaced in a stove stand, the curling irons may lose a significant amount of heat and not be effective when reused or applied to a person's hair.

For those and other reasons, a need exists for a hair styling tool organizer that, among other things, can help manage, secure, and/or maintains a plurality of tools or instruments.

SUMMARY OF THE INVENTION

Accordingly, a tool organizer is disclosed. The organizer is comprised of a main body portion and a lip portion. The main body portion includes one or more wells, each well having a longitudinal length and a depth, well walls, and a front portion having an opening for receiving at least a portion of a tool. The lip portion is positioned adjacent the main body portion and includes one or more receiving members.

DETAILED DESCRIPTION OF PREFERRED EMBODIMENTS

Figure 1A:
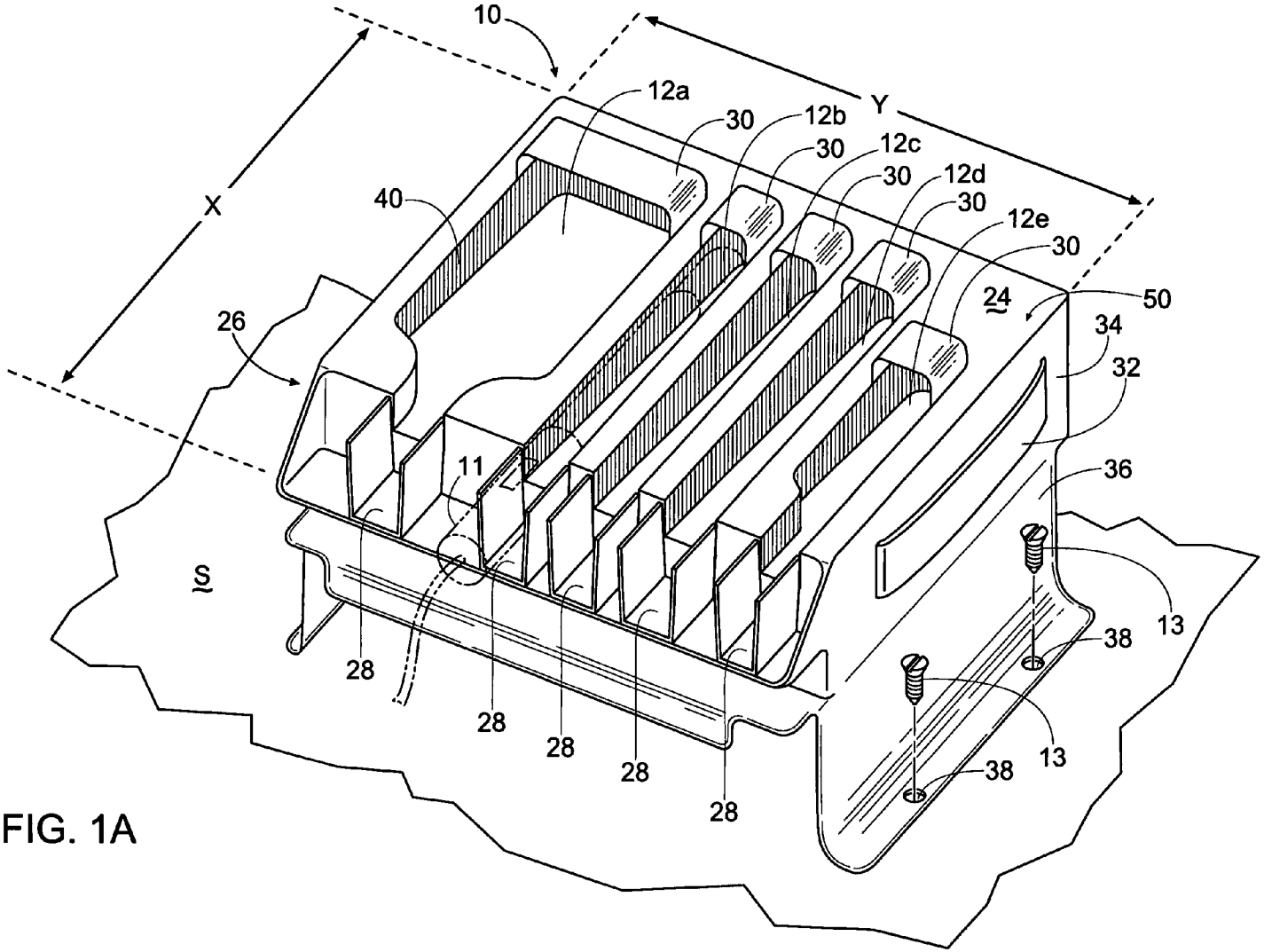
FIG. 1A is a perspective view of a tool organizer according to an embodiment of the invention.
Figure 1B:
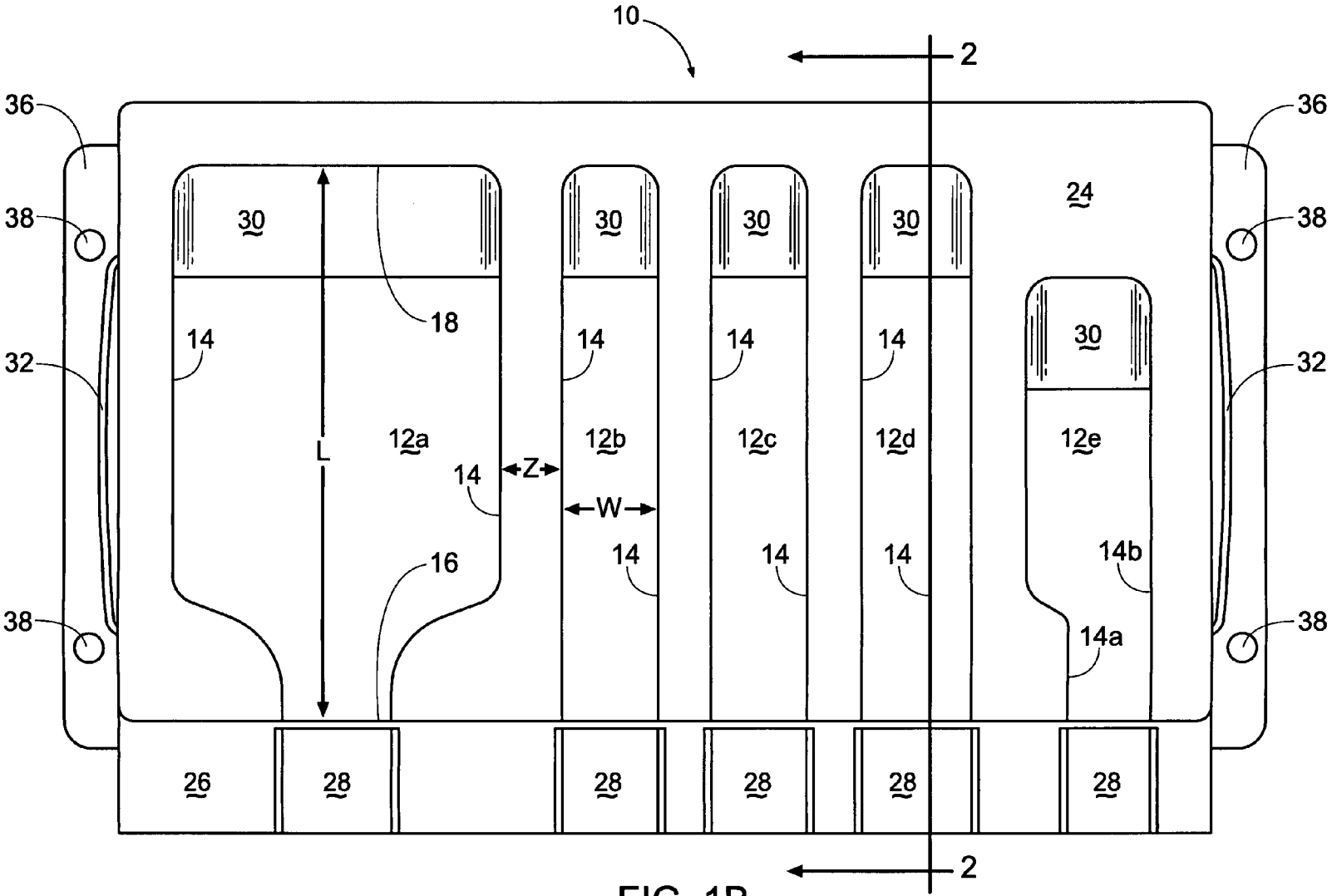
FIG. 1B is a top view of the organizer according to FIG. 1A.
Figure 2:
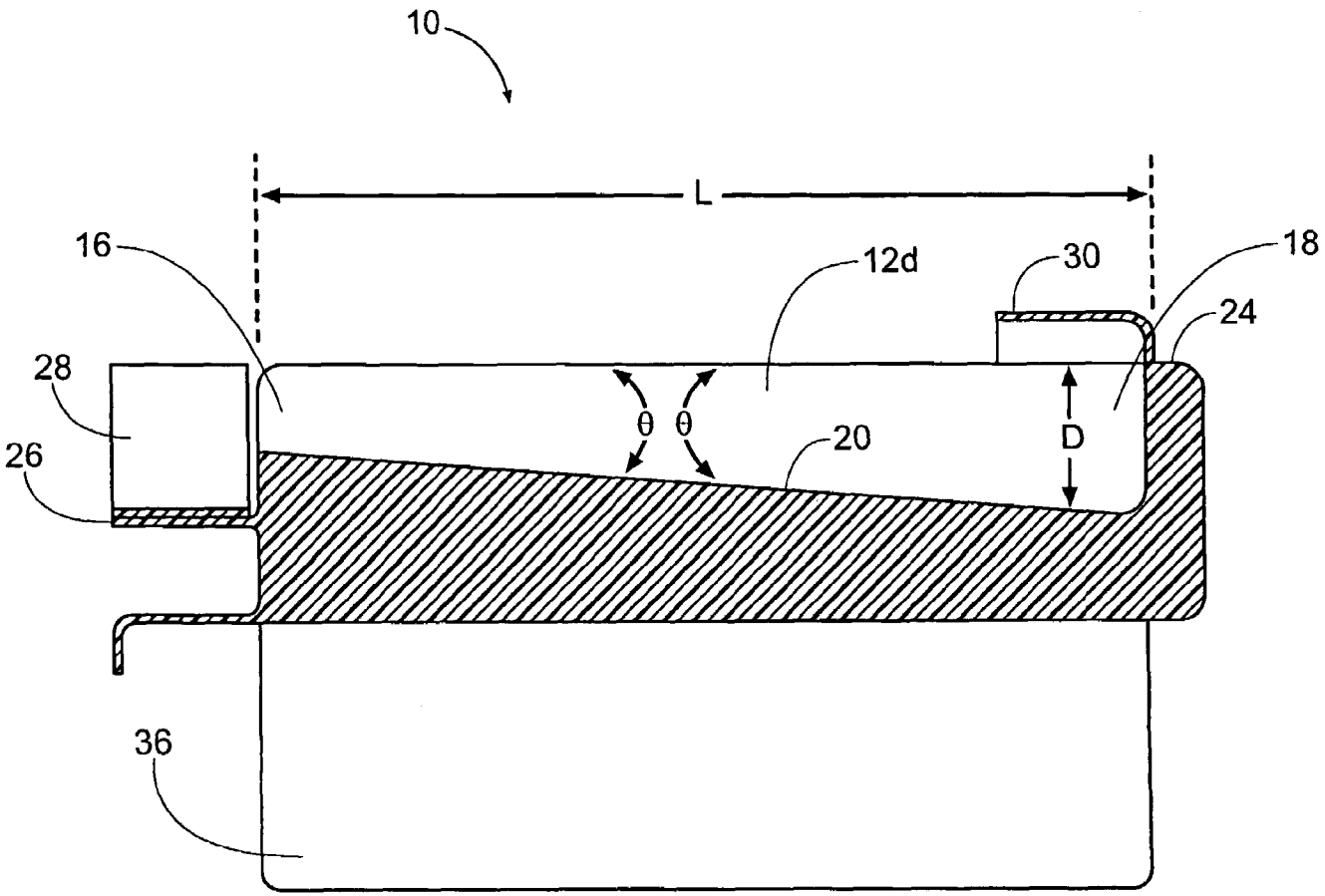
FIG. 2 is a cross sectional view of the organizer according to FIG. 1A.

A tool organizer 10 according to an embodiment of the invention is illustrated in FIGS. 1A–1B, and 2. In a preferred embodiment, the organizer 10 may be configured to receive one or more tools—such as hair styling tools—and is substantially comprised of an appropriate material or several materials. The overall structure is preferably light-weight and the organizer 10 may be comprised of any desirable materials that are suitable for contact with portions of associated tools under typical service conditions, which may include elevated temperatures.

In a preferred embodiment, a significant portion of the organizer 10 may be comprised of a ceramic material. However, the invention is not limited to ceramics, and the organizer can be comprised of other materials, such as steel, or the like, whether alone or in combination. Moreover, for many applications it is desirable to use materials that help to retain the operating temperature of the tools 11, such as curling irons. Preferably, at least the main body portion of the organizer 10 is pre-cast, for instance, via a continuous forming process, and is designed to have a desirable width, X, and length, Y, relative to typical conventional countertop or storage space. In a preferred embodiment, without limitation, the length, Y, may be approximately ten to twenty inches or more, and the width, X, may be approximately six to ten inches or more.

To accommodate the various shapes and sizes of tools 11, the main body portion 50 of the organizer 10 includes a means for holding or managing tools, which may include one or more wells 12. An example of an arrangement of wells is generally represented by elements 12*a*–12*e* in FIG. 1A. The wells 12 may have any desirable width, W, length, L, and depth, D, as generally illustrated in FIGS. 1B and 2. As seen more clearly in FIG. 1B, for descriptive purposes, each of the widths, W, is referenced from a well wall 14, the wells terminating at an opening near a front portion, identified as 16. Lengths, L, are generally referenced from a front portion 16 to a rear portion 18.

Many styling tools 11, such as curling irons, have an extended length. Such tool lengths can be up to five inches or more (not including the handle portion of the iron). Correspondingly, the length, L, of the each well 12*a*–12*e* is preferably the same as or slightly greater than the length of the portion of the associated tool that is intended to be placed in the well. However, the length of each well 12*a*–12*e* is not limited to a given measurement, and may be any desirable length, particularly with respect to common or desired types of tools. Moreover, the lengths of each well can be, but need not be, the same. For instance, as shown in FIG. 1B, the length of any given well (such as 12*e*) may be less than the lengths associated with one or more (or even all) of the other wells.

The depth, D, of the well may be substantially uniform or, may be varied along the length, L, of the well. For example, as generally shown in FIG. 2, the well bottom 20 may include one or more slopes that vary the depth D of the well along its length. In a preferred embodiment, the well bottom 20 declines (and depth D increases) moving from the front portion 16 to the rear portion 18 of the well 12 at an angle, θ, which is taken relative to a generally planar top surface 24. In alternative embodiments, the wells (including individual wells of the same organizer) may have varying angles, θ, that provide varying well slopes.

Moreover, the well bottoms 20 are not required to be substantially flat. Rather, portions or segments of the well bottom 20, taken along length L, may take on the form of V-shape or U-shaped channels or grooves (viewed in cross section looking down length L of the wells).

The diameter of most typical styling tools such as curling irons 11 is about one inch; therefore, the depth, D, and width, W, of each well 12 is preferably greater than one inch in order to accommodate various irons and other tools. However, it is noted that the width, W, is not critical to the invention and may alternatively be any desirable dimension, such as for instance, approximately seven-eighths-of-an-inch, once inch, one-and-one-eighths-of-an-inch, one-and-two-eighths-of-an-inch, or three inches. Similarly, as previously noted, the depth, D, may be any desirable depth but is preferably from about one-quarter-of an-inch to about three inches.

The well walls 14 are preferably substantially perpendicular to the surface on which the organizer rests. However, if desired, the walls 14, or an upper portion of the walls) can be chamfered or flared outwardly from the well bottom 20 at a given angle, curve, or combination thereof to create a wider entry or reception area to the well 12.

As illustrated in FIG. 1B, the footprint or plan view perimeter of each well 12 can comprise various shapes and configurations. Opposing well walls 14 for individual wells 12*b*–12*d* are illustrated as substantially parallel and mirror one another along their respective lengths. However, an almost limitless number of configurations are possible. Each opposing well wall 14 does not have to be substantially parallel to one another (e.g., well 12*a*) and, further, may (e.g., well 12*a*) or may not mirror one another along all or a portion of their corresponding lengths (e.g., well 12*e*). Further, as desired, the wall portion at the rear portion 18 may be generally round, curved, straight, angled, or a combination of one or more of the foregoing.

Referring back to FIG. 1B, the organizer 10 also includes a separate or integral lip portion 26 that is located in front of the front portion 16 of the wells. Lip portion 26 further includes one or more receiving members. The receiving members comprise a means for generally supporting, holding and/or securing a portion of a tool, commonly a portion of a handle. In a preferred embodiment, the receiving member includes one or more clips or support devices having vertically-extending and opposing surfaces 28. Preferably, the receiving member supports and/or secures a portion of the tool for access by a user and generally prevents the associated tool from sliding from side to side at that position. However, if desired, other forms of clips or conventional supports may instead be used.

Further, if a clip or similar device is used, depending upon the form of the portion of tool to be retained or supported by the receiving member, the distance between corresponding opposing surfaces 28 of the clip may be less than, the same, or greater than the distance of the associated opening to the well 12.

The organizer 10 may optionally include one or more well hoods 30 that correspond to an associated well. A well hood 30 may be used to cover a portion of a well, preferably a portion at or adjacent to the front portion 16 of the well 12. Working in coordination with one another, receiving members and the well hoods 30 can assist in supporting and securing tools placed within a portion of a well 12.

In order to assist in the support and/or securing of tools 11, the receiving members may be positioned on the lip portion 26 at the same or a slightly higher (or even a lower) elevation than the well bottom 20 near the front portion 16 of the wells 12. The receiving member may also be designed to assist in supporting and/or securing the electric cords associated with the tools 11.

If desired, the receiving members and well hoods 30 may be integrally formed with the same material that comprises the general structure of the materials forming the wells of the organizer 10. Alternatively, the receiving member may comprise a different material and can be separately connected to or affixed to the hair organizer 10. If the receiving member comprises a different material, the material may be selected from a suitable flexible material, such as spring steel, that may pinch and grip onto a handle portion or electrical cord of a tool 11. Accordingly, if a handle or other extension of a tool 11 is accidentally bumped while it is housed within its respective well 12, a number of features, including without limitation, the slope of the well bottom 20, the receiving member, and/or the well hood 30, may (taken alone or in combination) prevent the curling iron from ejecting out of the well 12.

As seen in FIGS. 1A–1B, the organizer 10 may also include one or more handles 32, preferably located on a side 34 of the organizer 10. Essentially, the handles 32 gives the user the ability to lift and relocate the organizer 10 in various locations without having to directly touch a surface, such as the top surface 24 or a well wall 14. For example, if the hair styling tool organizer 10 comprises a material that retains a significant amount of heat, the handles 32 allow the user to grip and lift the organizer 10 without having to directly touch a heated surface, which could potentially be extremely hot.

As also seen in FIGS. 1A–1B, the organizer 10 may also include a base portion 36. If desired, the base portion 36 may further include one or more frictional "skid pads" (not shown) and/or a plurality of openings 38 or other conventional means for securing the base portion 36 to another surface or structure. In one embodiment, the base portion 36 may be secured to another surface by way of a screw 13. If openings 38 are used as a securing means, they offer the flexibility to rigidly secure the tool organizer 10 to a support surface, S. The support surface, S, may be a variety of surfaces that have different ambient temperatures. A first location of the support surface, S, may be a stove or oven that continuously heats the hair styling tool organizer 10 and the curling irons 11. A second location may be a countertop, e.g., a Formica countertop. Moreover, if the organizer 10 is placed on a countertop that is generally at room temperature, the base portion 36 essentially elevates the organizer 10 from the surface, S, at a distance that may help to reduce the amount of heat emitted thereto, which may otherwise damage the surface. In a preferred embodiment, the base portion 36 may include formations for controlling the dissipation of heat from the organizer, such as a plurality of ridges or fins on the underside of the base portion adjacent to the main body portion of the organizer 10.

As suggested above, the overall design of the organizer 10 may incorporate the characteristic of heat stabilization for heating the tools 11. This feature may be further induced by designing wells 12 that are adjacently spaced at a minimal distance, Z (FIG. 1B). Because each well 12*a*–12*e* is separated by a minimal distance, Z, the heat from a tool (such as a curling iron) that is placed in any of the wells 12*a*–12*e* may be conducted through and penetrate its respective well wall 14 and aid its neighboring well in order to maintain a workable curling iron temperature.

Alternatively, the tool organizer 10 may also include means for absorbing and reflecting heat, such as a trim material 40 (FIG. 1A) that may be disposed over all or a portion of each well wall 14. The trim material 40, for example, may comprise a metallic material that can absorb and reflect heat back within the well. The reflective characteristic of the trim material 40 helps retain the heat within a well rather than dissipating the heat through the walls 14 as described above.

In yet another alternative embodiment, the trim material 40 may act as a heat sensor, such as a heat sensitive paper that blackens at a specific temperature. For example, in this embodiment, the trim material 40 may indicate that the wells 12*a*–12*e* are too hot. Essentially, the trim material 40 would blacken and indicate to the stylist that an iron 11 may also be heated beyond a useful a temperature, which could potentially burn a customer's hair.

Figure 3A:
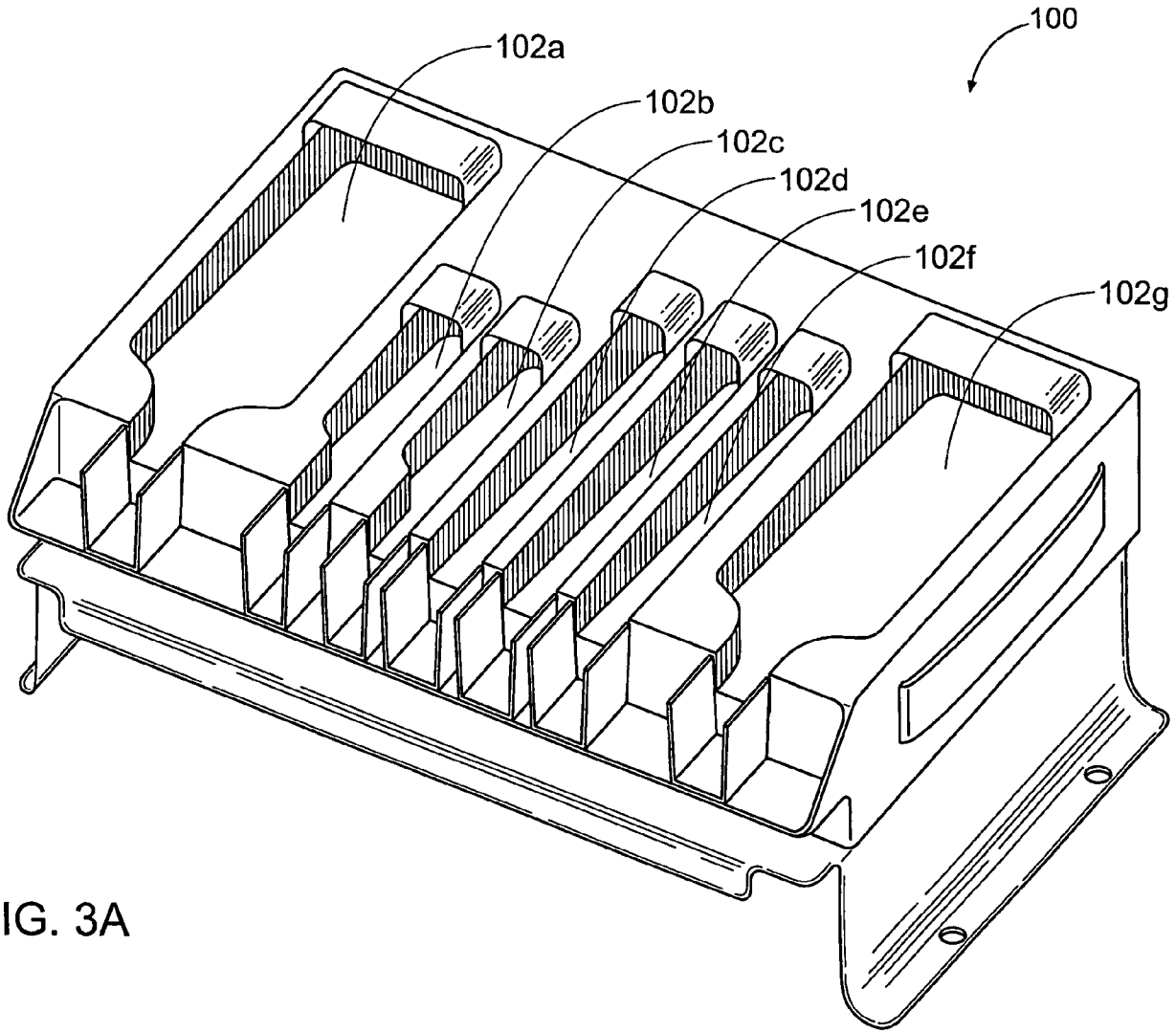
FIG. 3A is a perspective view of a tool organizer according to another embodiment of the invention.
Figure 3B:
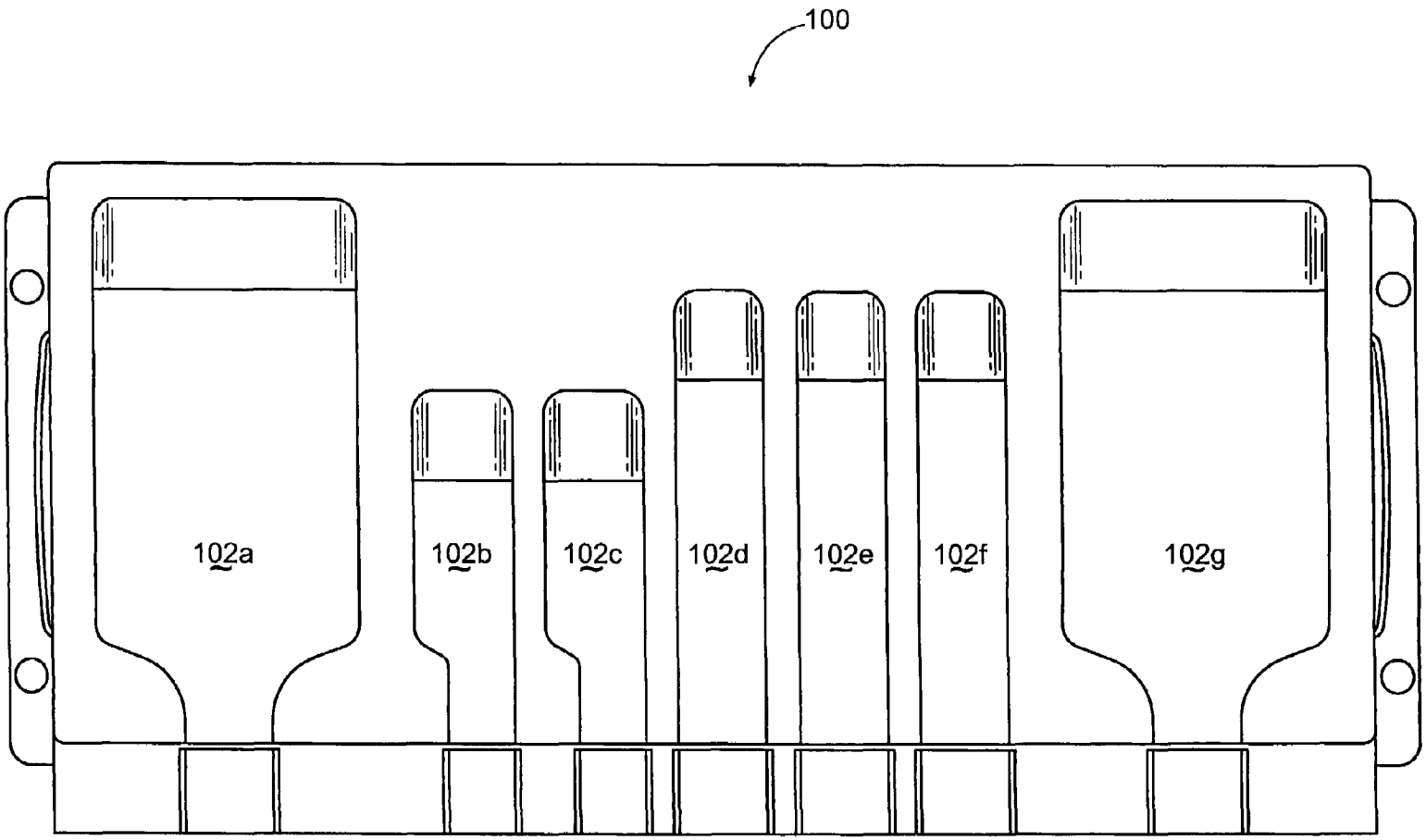
FIG. 3B is a top view of the organizer according to FIG. 3A.

As illustrated in FIGS. 1A–1B, the tool organizer 10 includes five wells 12*a*–12*e*. However, a stylist may need use and access more than five irons 11 when styling a customer's hair, or, in another situation, two or more stylists may share an organizer, which may then result in the need for duplicate tools 11. Therefore, in an alternative embodiment as seen in FIGS. 3A–3B, an organizer 100 may comprise seven wells, generally shown as 102*a*–102*g*.

Figure 4A:
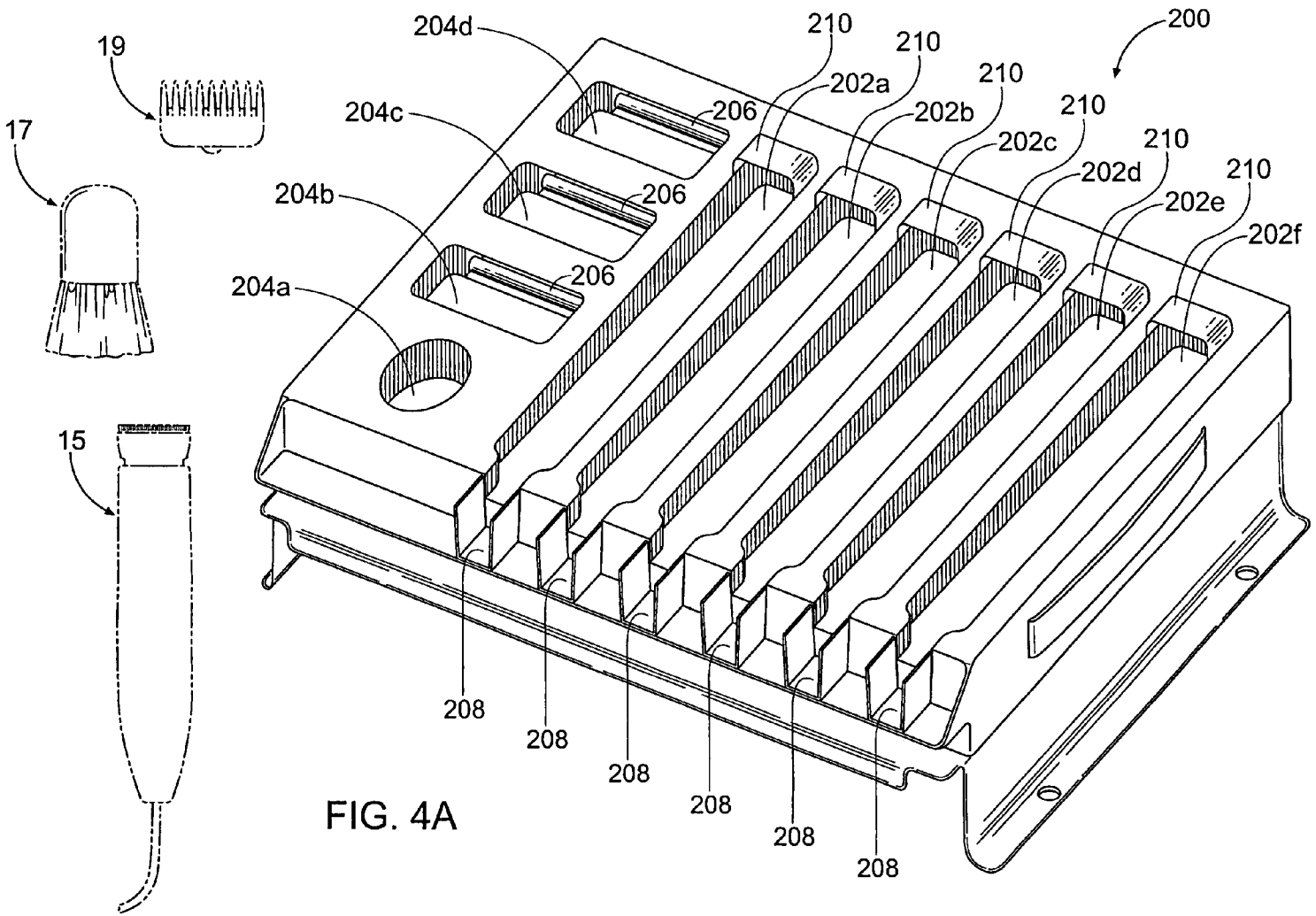
FIG. 4A is a perspective view of a tool organizer according to another embodiment of the invention.
Figure 4B:
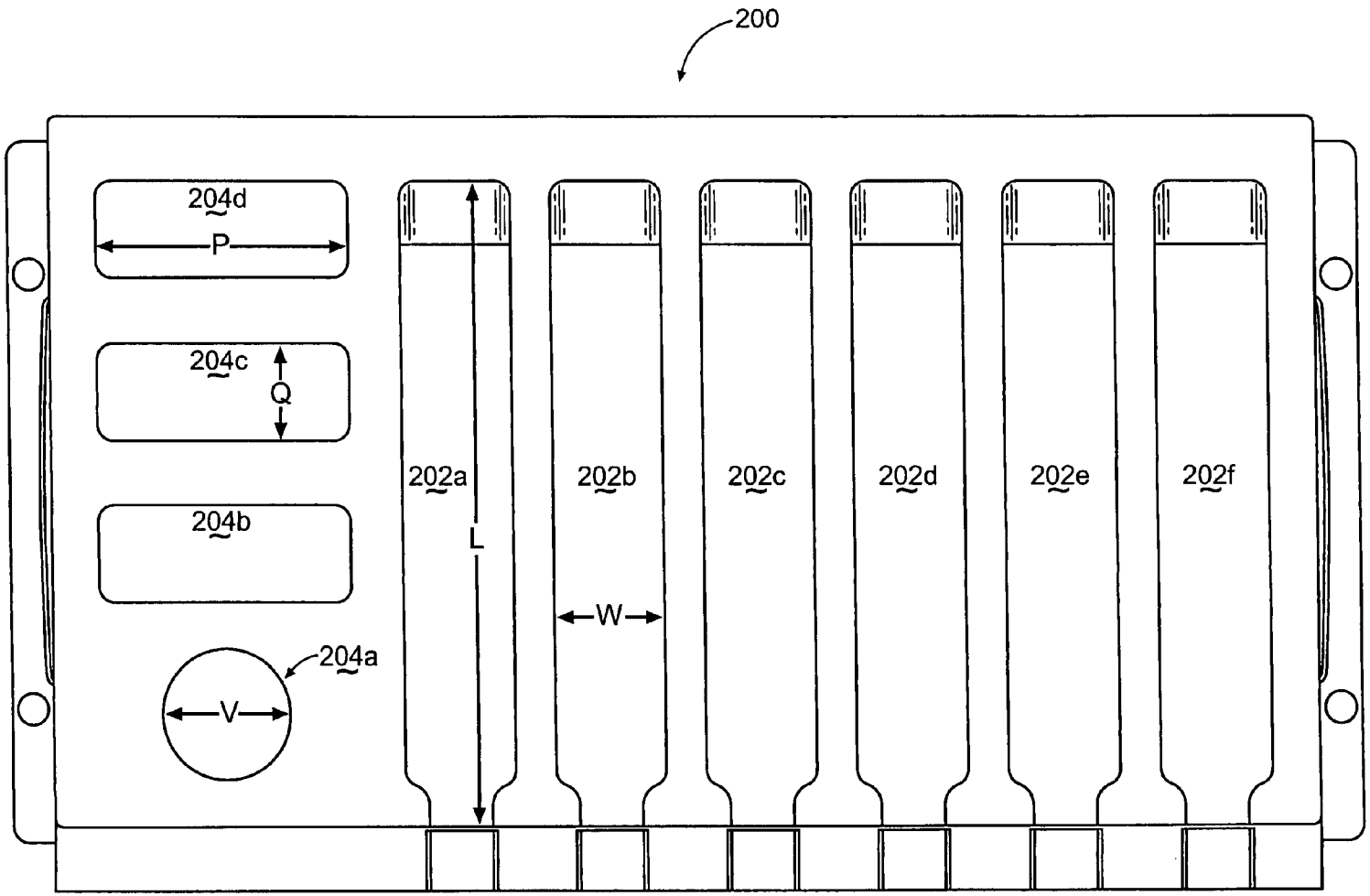
FIG. 4B is a top view of the organizer according to FIG. 4A.

In yet anther alternative embodiment of the invention, such as generally illustrated in FIGS. 4A–4B, a tool organizer 200 may include one or more electric tool (e.g., clipper, guards, etc.) wells, here shown as 202*a*–202*f*. The clipper wells 202*a*–202*f* are similar in design to the wells 12*a*–12*e* described above that accommodates tools 11. Essentially, the electric clipper wells 202*a*–202*f* may store a variety of electric clippers or other electric devices 15. As seen in FIG. 4B, the length, L, width, W, and depth (not shown), of each electric clipper well 202*a*–202*f* may comprise any desirable dimension as similarly described above in FIGS. 1A–1B, and 2. For example, without limitation, the length, L, of the wells 202*a*–202*f* may vary from approximately six to ten inches, the width, W, may be approximately three inches, and the depth may be approximately one inch.

Referring back to FIG. 4A, the hair styling tool organizer 200 may also comprise one or more additional wells 204*a*–204*d* for accommodating items, such as a brush 17, interchangeable clipper blades 19 (with or without guards), respectively. As seen in FIG. 4B, the well 204*a* may be circular and generally defined by a diameter, V, and other square or rectangular wells 204*b*–204*d* may be generally defined by a length, P, and a width, Q. The diameter, V, of the well 204*a* may be any desirable diameter that accommodates the reception of a handle of the brush 17 or other styling tool. For example, the diameter, V, may be approximately one or two inches. The length, P, and width, Q, of each well 204*b*–204*d* may comprise any desirable dimensions. For example, the width, Q, may be approximately one-half-of-an-inch, and the length, P, may be two, two-and-a-half-inches, or three-and-three-fourths-of- an-inch.

As illustrated in FIG. 4A, the wells 204*b*–204*d* may also each include sterilizing lamps 206, which may be activated by an electrical switch (not shown) for sterilizing the clipper blades 19 after use. To help provide more room for items, such as clipper blades 19 and/or guards (not shown), in the wells 204*b*–204*d*, a sterilizing lamp 206 may alternatively be recessed within the wells 204*b*–204*d*.

Although a specified depth is not shown for the representative wells 202*a*–202*f* and 204*a*–204*d*, any desirable depth having a desirable angle (relative to the upper surface) may be used in a similar fashion as that described above in connection with earlier embodiments. Even further, brackets 208 may be specifically configured or designed to pinch and grip a handle portion of the electric clippers 15, or, alternatively, the brackets 208 may manage and maintain an electric cord that extends from the electric clippers 15, and corresponding hoods 210 may assist in securing the tools in the respective wells 202*a*–202*f*.

While the physical configurations of the alternate embodiments of the hair styling tool organizers 10, 100, 200 are shown FIGS. 1A–4B, it is important to note that the present invention is not limited to a single physical configuration and may be defined to include wide variety of sizes and shapes. For example, without limitation and as previously noted, the tool organizer may comprise an amalgam of the designs illustrated above to include wells for curling irons, brushes, electric clippers, clipper guards, marcel curling irons, pressing combs, interchangeable clipper blades, or the like on a single unit. In another example, one or more sterilization lamps may be included in the design of the wells to accommodate curling irons or other tools. In yet another example, the well walls may include various shapes at the neck potion or at the rear portion of each well.

Each hair styling tool organizer 10, 100, 200 can be designed to provide optimized or improved management, movement, securing, and/or heat stabilization of a plurality of styling tools, such as curling irons, interchangeable clipper blades, or brushes.

While the invention has been specifically described in connection with certain specific embodiments thereof, it is to be understood that this is by way of illustration and not of limitation, and the scope of the appended claims should be construed as broadly as the prior art will permit.

What is claimed is:

1. A tool organizer for storing one or more styling tools having a heated portion and a handle portion above a support surface, comprising:

a main body portion including one or more wells adapted to hold the heated portion of the styling tool, said one or more wells having a longitudinal length and a depth and further including well walls;

a lip portion positioned adjacent the main body portion and including one or more receiving members positioned outside of the wells for supporting or retaining a portion of the handle portion of the tool at an elevated position relative to the heated portion, the receiving members including a clip or support device with opposing surfaces for supporting or retaining the handle portion of the tool; and a base portion that supports the main body portion above said support surface.

2. An organizer as recited in claim 1, wherein the body portion has a substantially planar top surface.

3. An organizer as recited in claim 1, wherein the receiving member is comprised of one or more vertically extending opposing surfaces.

4. An organizer as recited in claim 1, wherein the receiving member is comprised of one or more clips.

5. An organizer as recited in claim 1, including at least one well hood located above a portion of at least one well.

6. An organizer as recited in claim 5, wherein the well hood is located over a rear portion of the well.

7. An organizer as recited in claim 1, wherein the wells are configured to receive a portion of a tool.

8. An organizer as recited in claim 1, wherein the wells include at least one sterilization lamp.

9. An organizer as recited in claim 8, wherein the lamp is located in operational proximity to a well.

10. An organizer as recited in claim 1, wherein the depth varies along the longitudinal length of the well.

11. An organizer as recited in claim 10, wherein the depth increases from the front portion of a well towards a rear portion of a well.

12. An organizer as recited in claim 1, including at least one handle.

13. An organizer as recited in claim 1, wherein the base portion and the body portion are integrally formed.

14. An organizer as recited in claim 13, wherein the base portion is connected to the main body portion.

15. An organizer as recited in claim 14, wherein the base portion includes a connection feature for attachment or connection to said support surface.

16. An organizer as recited in claim 14, wherein the connection feature consists of one or more of the following: a skip pad, a connection opening, a means for connecting to a support surface.

17. An organizer as recited in claim 1, wherein wells are configured to permit heat to transfer to adjacent wells by way of conduction or to be dissipated from the organizer.

18. An organizer as recited in claim 1, wherein the well wall includes a material disposed over the well wall.

19. An organizer as recited in claim 18, wherein the material comprises a metallic material.

20. An organizer as recited in claim 19, wherein the material is heat sensitive and functions as a heat sensor.

21. An organizer as recited in claim 1, wherein the main body portion is comprised of a ceramic, a metal, or a combination of a ceramic and a metal.

22. A tool organizer, comprising a main body portion including a means for holding a heated portion of a styling tool;

a lip portion positioned adjacent to and outside of the means for holding a heated portion of said styling tool, the lip portion including a means for supporting a handle portion of said styling tool at an elevated position with respect to the heated portion of said styling tool; and a means for supporting the main body portion above a support surface such that the majority of the main body portion is supported in a non-contacting manner above said support surface.

23. A tool organizer, comprising:

a main body portion having a substantially planar top surface and including one or more wells and one or more well hoods covering at least a portion of a well, said well having a longitudinal length and a varying depth and further including well walls and a front portion having an opening for receiving at least a heated portion of a tool;

a lip portion positioned adjacent the main body portion and including one or more receiving members positioned outside of the wells and comprising vertically extending opposing surfaces that support or retain a non-heated portion of the tool at an elevated position relative to the heated portion of the tool; and a base portion connected to the main body portion, the base portion configured to support the organizer above a support surface and including a connection feature.

* * * * *